United States Patent [19]

Nordeen et al.

[11] 3,995,151

[45] Nov. 30, 1976

[54] LIGHTING ORNAMENT

[75] Inventors: Peter Nordeen; Carl C. Lienau, both of New York, N.Y.

[73] Assignee: Peter Nordeen et al., New York, N.Y.

[22] Filed: Jan. 23, 1975

[21] Appl. No.: 543,637

Related U.S. Application Data

[63] Continuation-in-part of Ser. No. 417,428, Nov. 19, 1973, abandoned.

[52] U.S. Cl. ..... 240/10 A; 240/2 LC; 240/2 LF; 40/106.21

[51] Int. Cl.[2] ..... F21P 7/00

[58] Field of Search ..... 240/10 R, 10 A, 2 LC, 240/2 LF; 40/106.21

[56] References Cited

UNITED STATES PATENTS

| | | | |
|---|---|---|---|
| 1,979,336 | 11/1934 | Martin et al. | 40/106.21 |
| 2,054,275 | 9/1936 | Vellner | 40/106.21 |
| 2,713,629 | 7/1955 | Etzkorn | 240/10 R |
| 3,058,245 | 10/1962 | Pieters | 240/10 R |
| 3,714,414 | 1/1973 | Sternius | 240/10 R |

*Primary Examiner*—Russell E. Adams, Jr.
*Attorney, Agent, or Firm*—Morris I. Pollack

[57] ABSTRACT

A tubular member of predetermined length is arranged in an ornamental fasion, such as a helix disposed in conical or cylindrical configuration or as a festooned member, and is adapted to contain a first fluid, such as water, and to receive a second fluid, such as air, which is lighter than water and which passes through the first fluid in pockets separated one from the other. Seat defining means are carried by the tubular member as either a continuous or discontinuous strip and so as to receive illumination means which when illuminated coacts with the first fluid and the second fluid, as it passes through the first fluid, to provide a pleasingly aesthetic effect. A conduit member may also be carried by said tubular member to act as a return for the second fluid; and suitable pump means are provided to inject said second fluid into said first fluid. If desired particles of reflecting material may be dispersed in said first fluid.

18 Claims, 9 Drawing Figures

Fig. 1.
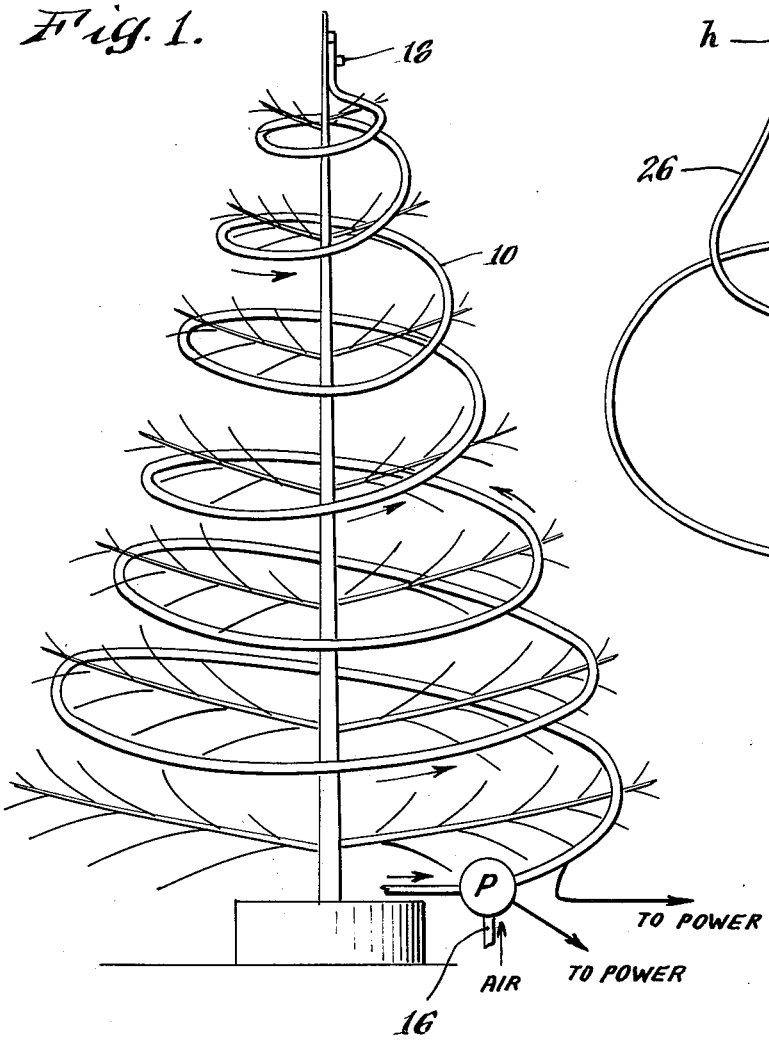
Fig. 4.
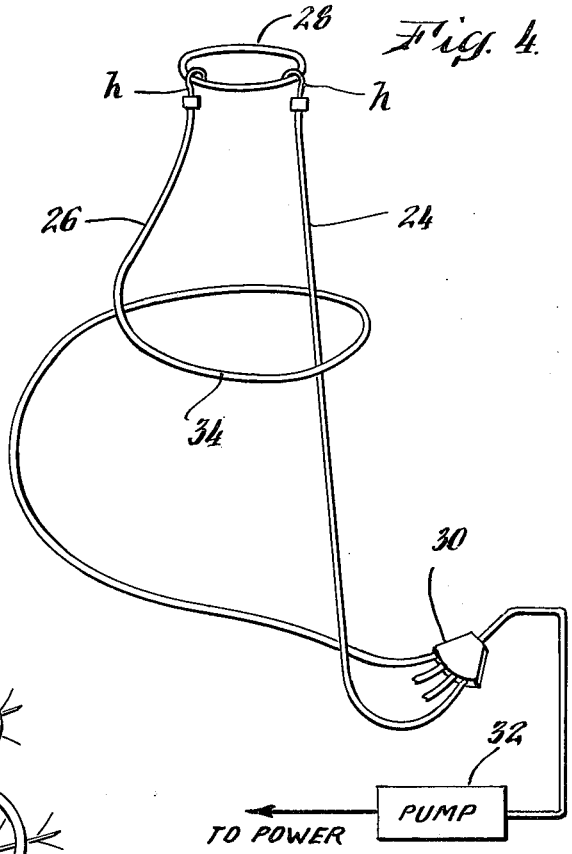
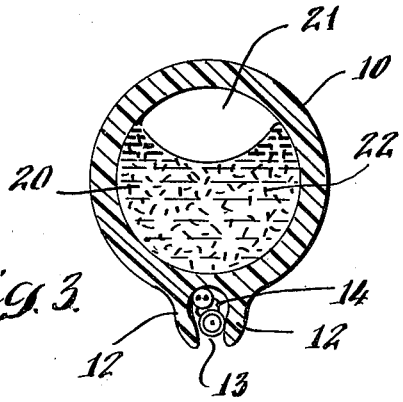
Fig. 3.
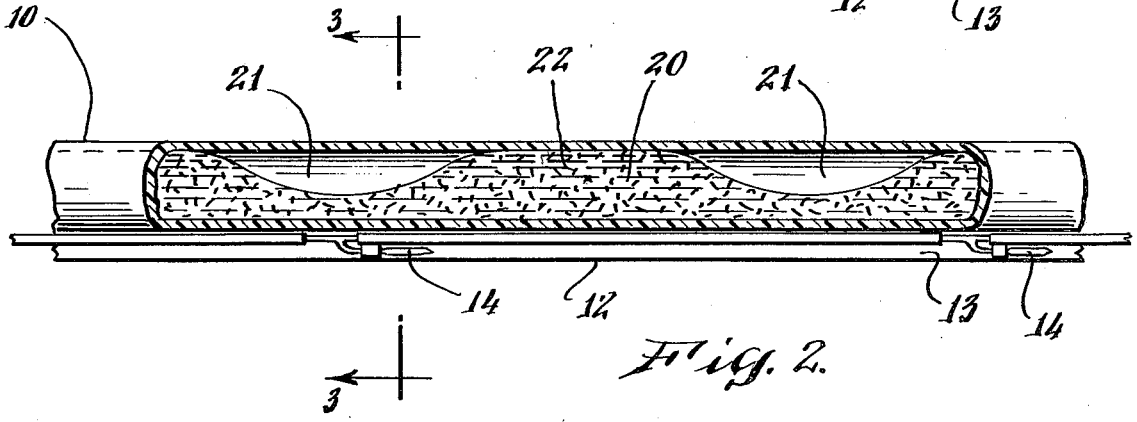
Fig. 2.

LIGHTING ORNAMENT

This application is a continuation-in-part of our copending application Ser. No. 417,428 dated Nov. 19, 1973 for Lighting Ornament, now abandoned.

BACKGROUND OF THE INVENTION

1. Field of Application

This invention relates to a lighting ornament, and more particularly to a lighting ornament which contains a first fluid and receives a second fluid which passes through said first fluid in pockets separated one from the other.

2. Description of Prior Art

Lighting ornaments are presently known wherein air is bubbled through a liquid in tubular and other containers, and wherein the coaction of the air bubbling through the liquid is illuminated for the esthetic effect thus obtained. Devices such as those shown in U.S. Pat. No. 1,835,311 granted to A. K. Krakau on Dec. 8, 1931 for Electrical Advertising Apparatus, and in U.S. Pat. No. 3,058,245 granted to S. D. Pieters on Oct. 16, 1962 for Luminous Advertising and Display Means are quite typical. However, these devices are cumbersome to handle and complex in construction and operation.

SUMMARY OF THE INVENTION

It is therefore an object of this invention to provide a novel and improved lighting ornament.

It is another object of this invention to provide a novel and improved lighting ornament incorporating first and second coacting fluids.

It is still another object of this invention to provide novel and improved lighting ornament wherein a tubular member is adapted to receive first and second coacting fluids and is further adapted to be arranged in an ornamental configuration.

Yet still a further object of this invention is to provide a novel and improved lighting ornament wherein a tubular member, adapted to receive first and second coacting fluids and to be arranged in an ornamental configuration, carries a seat defining means for positioning lighting means along its length.

Yet still another object of this invention is to provide a novel and improved lighting ornament wherein a tubular member, adapted to receive first and second coacting fluids and to be arranged either as a helix in conical or cylindrical configuration or to be festooned, carries a conduit member to provide a closed path for said second fluid as it moves out of said first fluid and back into said first fluid.

In carrying out the invention, according to the preferred embodiment thereof, a translucent tubular member is formed into an ornamental configuration and so as to receive a first fluid, such as water, which may have coloring added thereto. A second fluid, such as air, is pumped into said first fluid and passes in pockets through said first fluid. Means are carried by said tubular means along the length of said tubular member while conduit means may also be provided for providing a closed loop to retain the second fluid in the system.

Other objects, features, and advantages of the invention in its details of construction and arrangement of parts, will be seen from the above, from the following description of the preferred embodiment when considered in conjunction with the drawings and from the appended claims.

BRIEF DESCRIPTION OF THE DRAWINGS

In the drawings:

FIG. 1 is an elevational view of an embodiment of the invention in a helix of conical configuration as a Christmas tree ornament;

FIG. 2 is a longitudinal section taken through a portion of the embodiment of FIG. 1;

FIG. 3 is a cross section taken on line 3—3 of FIG. 2 showing a grooved seat for a string of lights or other lighting means;

FIG. 4 is an elevational view of a modified form of the invention;

DESCRIPTION OF THE PREFERRED EMBODIMENTS

Figure 5:
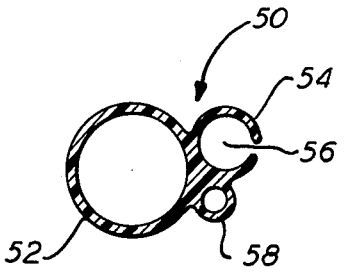
FIG. 5 is a cross-section, similar to that of FIG. 3, but of a tubular member of modified form.

For convenience the invention will be described as applied to a tube of circular cross-section and predetermined length disposed either as a helix of conical or cylindrical configuration or so as to be festooned and which is adapted to contain colored water and to have pockets of air pumped thereinto; it being understood, nevertheless, that without departing from the scope of the invention that subject lighting ornament can utilize a tubular member of any cross-section, which may be arranged in any helical or other configuration and wherein any first fluid, colored or not, may be contained for coaction with a second fluid, whether it be air or otherwise, as long as the second fluid can pass through said first fluid.

With reference to FIG. 1 there is generally shown at 10 a tubular member arranged in the form of a helix of conical configuration adapted to fit over and around a Christmas tree. Tubular member 10 is at least partially filled with a colored liquid, which may be water, and which will be visible when illuminated to provide a colorful and pleasing esthetic effect when illuminated.

As shown in FIGS. 2 and 3, tubular member 10 has longitudinally extending, outwardly projecting flange members 12 forming a snap tube. It is formed preferably of polyvinyl chloride to provide flexibility and snap action and so as to define a groove 13 which serves as a seat and support for a source of illumination extending along tubular member 10. Any suitable source of illumination may be used but a string 14 of lights, which may be of well known and conventionally available kind, is illustrated resting in seat 13 defined by flanges 12.

In helical tube 10 adjacent its lower end an inlet is indicated at 16 behind a small pump P. A suitable one-way valve (not shown) may be provided in inlet 16, the valve being adapted to open when pump P is energized, allowing a fluid, such as air, to be introduced into tube 10. The upper end of tube 10 is either open to allow air introduced by pump P to be vented from tube 10 or a port 18 is provided adjacent the top of tube 10, which may be controlled by a suitable valve (not shown) to vent air from tube 10. Alternatively a return conduit tube may be provided from port 18 to inlet 16.

When pump P is energized the air entering tube 10 serves to progressively lift portions of the liquid therein so that very soon there are lengths or areas of liquid 20 disposed at intervals along the helix from bottom to top, at least partly separated and spaced apart by areas of air 21. When the illuminated means is energized, the areas of colored liquid will be highly visible but the areas representing accumulations of air will not, thus producing a striking and ornamental effect.

A further part of the invention may be the provision in tube 10 of light reflecting flakes or particles 22. As the air moves up the tube 10 the particles 22 as well as the colored liquid will be raised and agitated thus causing the angles of the light reflecting surfaces of the flakes to change thereby modifying the ornamental effect of the device and creating a scintillating effect.

In the modified form of ornament shown in FIG. 4, a vertical tubular member 24 and a tubular member 26, which is partly vertical and partly horizontal, are shown hanging, as by means of hooks *h* from a supporting ring 28, which may be of metal, plastic or any suitable material, which may be slipped over the top of a Christmas tree or the like and supported by its top branches, thus providing support means from which one or more members 24 and one or more members 26 may be hung. The low ends of both members 24 and 26 extend to a manifold 30 which is supplied with liquid from the pump 32 which may be of the same kind as the pump P shown in FIG. 1.

It will be understood that the members 24 and 26 may be given any desired configuration, and it will be noted that tubular member 26 intermediate its end defines a loop 34 which may encircle a Christmas tree, for example.

The operation of members 24 and 26 is similar to the operation of the helical tube shown in FIG. 1, and suitable inlet and outlet valves may be employed at the bottom and top of members 24 and 26 respectively as described in connection with the helical employment of the invention as shown in FIG. 1.

Figure 6:
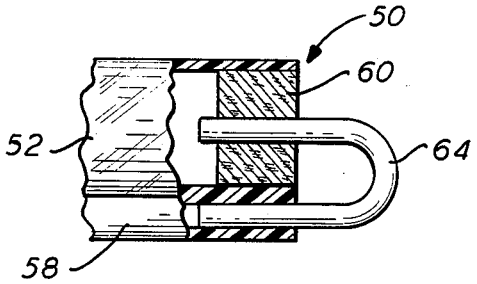
FIG. 6 is a short longitudinal end section of the tubular member of FIG. 5.

In FIGS. 5 and 6 a tubular member 50 of alternative form is shown. Tubular member 50 is similar to tubular member 10 (FIGS. 2 and 3) in that it has a main tubular portion 52 for containing fluids and a snap tube 54 (FIG. 5) forming a seat 56 for the illuminating means (not shown) which may be a string of lights. A tubular conduit 58 is shown formed proximate portion 52 and snap tube 54, but it may just as easily be formed at any other convenient location on tubular member 50. Conduit 58 extends the length of tubular member 52 and is utilized to provide a closed loop for the second fluid that is pumped into the fluid contained in tube 52.

As the second fluid passes from whatever fluid is contained in tube 52 it would normally exit into the air or be vented as provided in the embodiment of FIG. 1. In this embodiment a stopper 60 is fitted into the free and open end of tube 52 and is fitted with a loop tube 64 which has one end thereof in stopper 60 and its other end in conduit 58. In this manner fluid passing from the fluid in tube 52 can pass via loop tube 64 into conduit 58 and be returned to the pump (not shown) provided for circulating said fluid.

Figure 7:
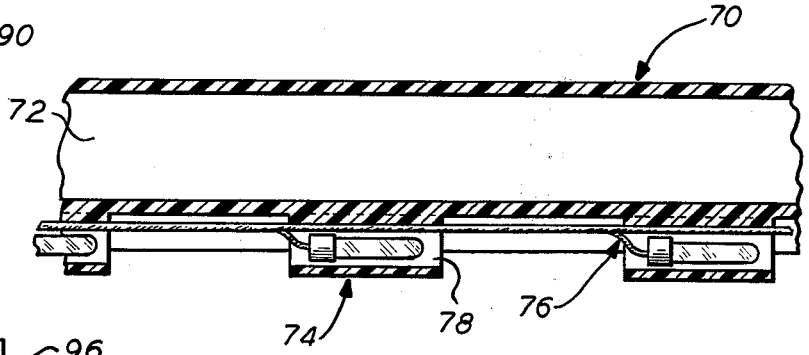
FIG. 7 is a longitudinal section similar to that of FIG. 2, but of a tubular member of modified form.

In FIG. 7 a tubular member 70 of alternative form is shown. Tubular member 70 is similar to tubular member 10 in that it has a fluid containing tube 72. It may also be provided with a return conduit (not shown), such as conduit 58 (FIGS. 5 and 6).

A snap tube 74, for positioning illuminating means 76 along the length of tubular member 70, is formed along tubular member 70 as a plurality or separate outwardly projecting flange members 78 similar to members 12 of FIG. 3 and which form a groove similar to groove 13 of FIG. 3.

Figure 8:
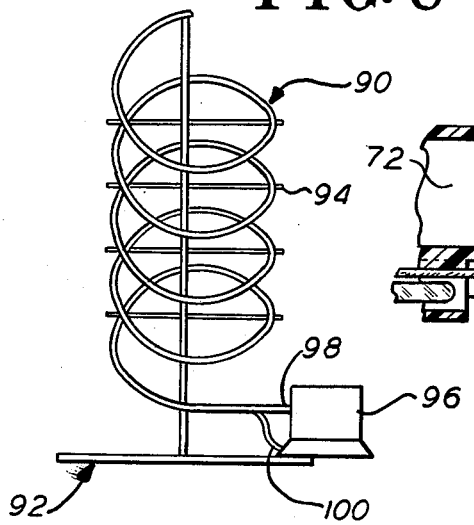
FIG. 8 is an elevational view of an embodiment of the invention in a helix of cylindrical configuration as an advertising or other ornament.

In FIG. 8 a tubular member 90 is formed as a helix of cylindrical configuration disposed as an ornament which may be used for advertising or similar purposes. A support 92 having branches 94 may be provided to position tubular member 90.

Tubular member 90 may be formed like tubular member 50 with a stopper and loop tube (such as stopper 60 and loop tube 64) at its free end. It is connected at its other end to a pump 96 with the output 98 thereof pumping a second fluid into the fluid tube portion of tubular member 90 and with the inlet 100 thereinto connected to the end of the conduit tube. Otherwise tubular member 90 carries illuminating means as for the embodiments of FIGS. 1 and 7 and functions like the ornaments described therefor.

Figure 9:
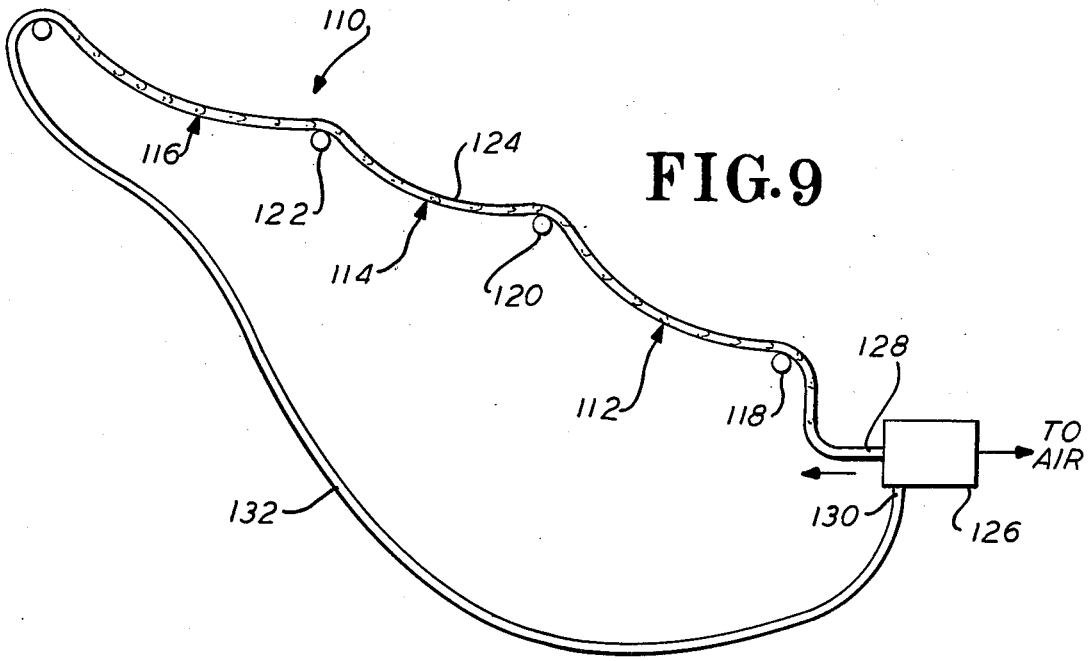
FIG. 9 is an elevational view of an embodiment of the invention in a festooned configuration.

In FIG. 9 a tubular member 110 is shown arranged in festooned fashion with sections 112, 114, 116 adapted to be draped over pegs, nails or similar type projection members 118, 120, 122. A first fluid 124 is contained in tubular member 110 and a pump 126 is provided to pump a second fluid, such as air, in fluid 124 through pump outlet 128. An inlet 130 is provided for pump 126 to receive the second fluid after it passes from the free end of tubular member 110. A return conduit 132 may be provided to return the second fluid to pump 126.

A snap tube (not shown) is provided for tubular member 110 in a manner similar to that shown in either FIGS. 2 and 3 or for FIG. 7. Appropriate illuminating means (not shown) are to be disposed in the snap tube. With pump 126 operating and the illuminating means illuminated the esthetic effect provided by the embodiment of FIG. 9 is similar to that provided by the other embodiments.

Tubular members 10, 24, 26, 50, 70, 90 and 110 are preferably formed of plastic and extruded in the desired configuration. Other materials and methods of formation are clearly usable. While they have been shown with circular cross sections other convenient cross sections, such as triangular, square, or hexagonal may be used for the main fluid containing tube and/or other portions thereof if suitable. Such tubular members are best formed of material which is generally flexible, however they may also be formed rigid or semi-rigid depending upon the ornamental use intended.

The first fluid, that is the one disposed in the main tubular portion, 20, 52, 72 etc., may not only be water or colored water but may be any desired fluid formulation depending upon the esthetic effect desired. While the second fluid has been generally described as air any other fluid which, once pumped into the first fluid, will bubble through the first fluid to provide the desired appearance is contemplated. Obviously any suitable pump is appropriate.

From the above description it will thus be seen that a novel and improved lighting ornament has been provided; which lighting ornament by utilizing a fluid tube which carries a lighting positioning means and may carry a second fluid conduit provides a simple and efficient lighting ornament capable of achieving pleasing and esthetic effects.

It is understood that although we have shown the preferred form of our invention that various modifications may be made in the details thereof without departing from the spirit as comprehended by the following claims.

We claim:

1. A lighting ornament comprising a. a translucent flexible tubular member having a first end and a second end and being closed at least at said first end;

b. longitudinally extending seat-defining means external of said tubular member and carried integral therewith;

c. a volume of liquid disposed within said tubular member;

d. a plurality of particles having light reflective surfaces disposed within said volume of liquid in said tubular member;

e. a plurality of lighting bulbs interconnected by electrical conducting means retained substantially wholly within said seat-defining means for illuminating said tubular member and said liquid and particles therein; and f. means for agitating said liquid and said particles in said tubular member and thus moving said particles and changing the angle of said light reflective surfaces of said particles.

2. The device claimed in claim 1 in which said tubular member is in the form of a helix.

3. The device claimed in claim 2 wherein a. a valve for admission of air is disposed proximate said first end of said tubular member;

b. a port for exhausting air from said tubular member is disposed proximate said second end of said tubular member; and c. said means for agitating said liquid and particles includes pump means connected to said tubular member so as to supply air into said tubular member so as to form air bubbles therein to agitate said liquid to cause said particles to change positions.

4. The device claimed in claim 3 in which said liquid is colored and visible when illuminated.

5. The device claimed in claim 3 in which said tubular member is in the form of a helix and adapted to fit over the top of, and around, a Christmas tree and the like.

6. An ornament comprising a. a translucent tubular member of predetermined length having a first end and a second end and being closed at at least said first end;

b. longitudinally extending seat-defining means external of said tubular member and carried thereby;

c. said tubular member being formed to contain a volume of fluid;

d. said seat-defining means being formed to contain therewithin illuminating means and electrical conducting means associated with the illuminating means for illuminating said tubular member and any fluid when contained therewithin; and e. means for agitating fluid when contained within said tubular member.

7. The ornament of claim 6 wherein a. a fluid conduit having a first end and a second end is carried by and extends along said predetermined length of said tubular member;

b. interconnecting means connect one of said ends of said tubular member to an adjacent one of said ends of said fluid conduit;

c. said other end of said fluid conduit and said other end of said tubular member coacting with said means for agitating fluid when contained within said tubular member.

8. The ornament of claim 7 wherein said means for agitating fluid includes pump means for pumping a second fluid into a first fluid when contained within said tubular member, wherein the second fluid is lighter than the first fluid and adapted to move therethrough.

9. The ornament of claim 8 wherein said pump means pumps air and said fluid conduit conducts air, which has passed through fluid when contained in said tubular member, back to said pump means.

10. The ornament of claim 6 wherein a. said seat-defining means is integrally formed with said tubular member; and b. said seat-defining means is formed as a tube formed with a slit like opening extending along its length in such a manner that said opening may be spread to facilitate receiving the illuminating means and will snap back thereagainst to retain, in snap tube like fashion, the illuminating means therewithin.

11. The ornament of claim 6 wherein said seat defining means is formed as a continuous member substantially coextensive with said predetermined length of said tubular member.

12. The ornament of claim 6 wherein said seat defining means is formed in discontinuous fashion along said predetermined length of said tubular member.

13. The ornament of claim 6 wherein a. a fluid conduit is carried by and extends along said predetermined length of said tubular member;

b. said tubular member, said fluid conduit, and said seat-defining means being integrally formed as an extrusion of plastic material.

14. The ornament of claim 6 wherein said tubular member is arranged as a helix.

15. The ornament of claim 14 wherein said helix is further arranged in a conical configuration.

16. The ornament of claim 14 wherein said helix is further arranged in a cylindrical configuration.

17. The ornament of claim 6 wherein said tubular member is arranged into a plurality of festooned sections.

18. The ornament of claim 6 wherein said tubular member is formed of flexible material to facilitate disposition thereof in various configurations.

* * * * *